United States Patent [19]

Akashi

[11] 4,389,758

[45] Jun. 28, 1983

[54] ORNAMENTAL ATTACHMENT FOR SLIDE FASTENER SLIDERS

[75] Inventor: Shunji Akashi, Kurobe, Japan

[73] Assignee: Yoshida Kogyo K.K., Tokyo, Japan

[21] Appl. No.: 271,602

[22] Filed: Jun. 8, 1981

[30] Foreign Application Priority Data

Jun. 24, 1980 [JP] Japan ..... 55-88394[U]

[51] Int. Cl.[3] ..... A44B 19/00

[52] U.S. Cl. ..... 24/205.11 R

[58] Field of Search ..... 204/205.15 H, 205.11 R

[56] References Cited

U.S. PATENT DOCUMENTS 4,078,278 3/1978 MacFee ..... 24/205.13 R 4,112,553 9/1978 Weitzer ..... 24/205.11 R

FOREIGN PATENT DOCUMENTS 958604 2/1957 Fed. Rep. of Germany .... 24/205.15 H 2907388 9/1979 Fed. Rep. of Germany ..... 24/205.11 L

*Primary Examiner*—Gene Mancene

*Assistant Examiner*—Wenceslao J. Contreras

*Attorney, Agent, or Firm*—Bucknam and Archer

[57] ABSTRACT

An ornamental attachment for a slide fastener slider with a pull tab, comprising a body having a channel for receiving therein the pull tab, a projection extending from one plate of the body into the channel for locking the pull tab in the channel, and a pair of spaced slits formed in the body and communicating with and extending longitudinally of the channel to define therebetween a resilient web portion which is displaceable against the resiliency thereof away from another plate in response to engagement between the pull tab and the locking projection when the pull tab is inserted into the channel, until the pull tab becomes locked by the locking projection.

9 Claims, 6 Drawing Figures

ORNAMENTAL ATTACHMENT FOR SLIDE FASTENER SLIDERS

BACKGROUND OF THE INVENTION

1. Field of the Invention

The present invention relates to an ornamental attachment mountable on the pull tab of a slide fastener slider.

2. Prior Art

A variety of ornamental attachments have been proposed for use as a decorative accessory to make the slider pull tab looking attractive and also for being handled by the user for reliable manipulation of the slider. One such proposal is disclosed in Japanese Utility Model Laid-Open-Publication No. 55-23187, published Feb. 14, 1980 and includes an elongate body of thermoplastic synthetic resin material having a slot into which the pull tab is forcibly inserted. The ornamental attachment has a slit extending transversely of the channel and partly defined by a projection which extends into the slot and which is locatable in a hole in the inserted pull tab to lock the attachment and the pull tab together. The known attachment, however, is disadvantageous in that some muscular effort needs be spent in mounting the attachment onto the pull tab since the slit has no function enough to assist the pull tab in moving over the projection. Another disadvantage of the prior attachment is that the slit extends normal to the slot into which the pull tab is inserted. When subjected severe stresses exerted each time the slider is manipulated on a slide fastener chain, the projection tends to wear or flex and sometime causes the slit to be broken at its ends. Such wear or flexing of the projection and breakage at the slit ends result in the risk of allowing the ornamental attachment to get disassembled from the pull tab. It has been proven that the foregoing problems become critical where the attachment is mounted on the pull tab of a slider on which severe lateral pull is exerted when closing a heavy-duty slider fastener such as attached to for example a diving suit.

SUMMARY OF THE INVENTION

An ornamental attachment for a slide fastener slider includes a body having a pair of spaced plates defining therebetween a channel receptive of the pull tab. One of the plates has a pair of spaced slits communicating with and extending longitudinally of the channel to define therebetween a resilient web portion. The resilient web portion is displaceable against the resiliency thereof in response to engagement between the pull tab and a locking projection projecting from one of the plates in the channel when the pull tab is inserted into the channel, until the pull tab becomes locked by said locking projection. The locking projection has a cam surface for causing the pull tab on engagement therewith to displace the resilient web portion against the resiliency thereof.

It is an object of the invention to provide an ornamental attachment for slide fastener sliders which can be attached to slider pull tabs easily in one-step operation.

Another object of the invention is to provide an ornamental attachment which, when once attached to a slider pull tab, is retained reliably and stably thereon against severe forces exerted which tend to pull the ornamental attachment off the pull tab as when manipulating the pull tab.

Many other advantages and features of the present invention will become manifest to those versed in the art upon making reference to the detailed description and the accompanying sheets of drawings in which preferred structural embodiments incorporating the principles of the present invention are shown by way of example.

DETAILED DESCRIPTION OF THE PREFERRED EMBODIMENTS

Figure 1:
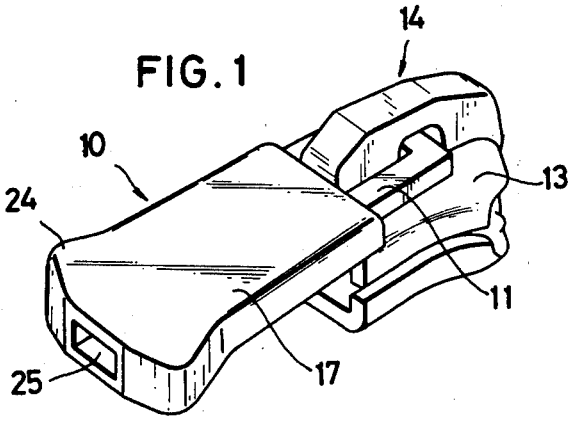
FIG. 1 is a perspective view of an ornamental attachment according to the present invention, as attached to a slide fastener slider.

Referring now to the drawing, wherein like reference characters designate identical or corresponding parts through the several views, and more particularly to FIG. 1, wherein an ornamental attachment 10 according to the present invention is fitted over a pull tab 11 pivotally coupled at one end or a pintle portion 12 (FIG. 2) to a slider body 13 of a slide fastener slider 14 made of metaric or non-metaric material. The pull tab 11 shown in FIGS. 2 to 5 has at its opposite or distal end an opening 15 and a centally located lateral projection 16 adjacent to the opening 15, the opening 15 being trapezoidal in shape but other shape may be applied to. The opening 15 and the lateral projection 16 double as an aid in assembling the slider 14 and as either a gripping aid when the slider 14 is used alone without the ornamental attachment 10 or a locking aid in combination with the ornamental attachment 10.

The ornamental attachment 10 is preferably made of synthetic resin but may be made other resilient material. The ornamental attachment 10 comprises an elongate body 17 having a channel 18 for receiving therein the pull tab 11, the channel 18 extending longitudinally of the body 17 from one end toward the other end such an extent that when the ornamental attachment 10 is fitted over the pull tab 11, a substantial part of the latter is received in the channel 18. Although not shown, the body 17 may be painted or engraved with a decorative pattern as desired. The channel 18 is defined by a pair of upper and lower plates or walls 19,20, a pair of sidewalls 21 spaced laterally from each other and interconnecting the upper and lower plates 19,20, and an end wall 22 located near the other end of the body 17. The body 17 also has a longitudinal guide groove 23 recessed in one of the plates or the upper plate 19 shown in FIGS. 2 to 5 and opening toward the channel 18 for guidingly receiving therein the lateral projection 16 of the pull tab 11. The channel 18 has a cross section complemental in contour to that of the pull tab 11 when viewed endwise of the pull tab 11.

The body 17 has an enlarged end portion 24 formed to flare toward the other end of the body 17 for assisting the operator in gripping the ornamental attachment 10 firmly when the slider 14 is manipulated. The end portion 24 has a slot 25 communicating at the end wall 22 with the channel 18 and the guide groove 23. The channel 18 has an opening 26 (FIGS. 3 and 4) positioned at one end of the body 17 in longitudinal spaced relation to the end wall 22.

Figure 2:
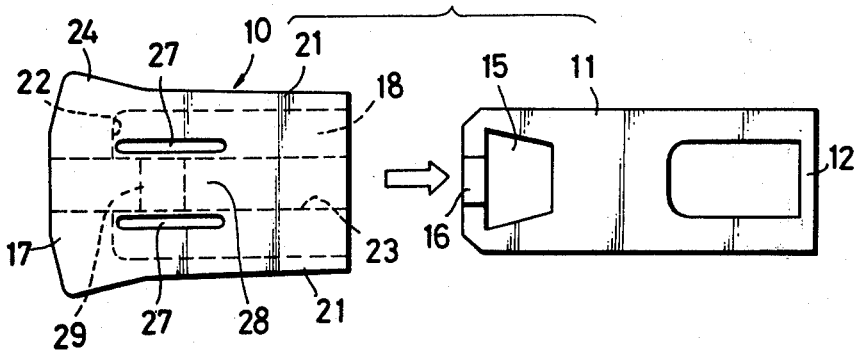
FIG. 2 is a plan view of the ornamental attachment as it is about to fit over a slider pull tab having a lateral projection thereon.
Figure 5:
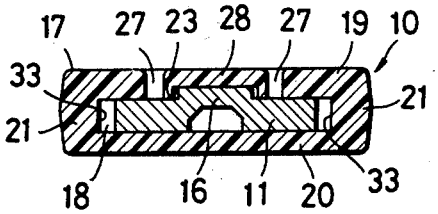
FIG. 5 is an enlarged cross-sectional view taken along line V—V of FIG. 4.

As best illustrated in FIGS. 2 and 5, the upper plate 19 has a pair of laterally spaced slits 27,27 communicating with and extending longitudinally of the channel 18 to define therebetween a resilient web portion 28. The slits 27 extend preferably in parallel and laterally aligned relation to on another. The resilient web portion 28 is displaceable against its own resiliency away from the lower plate 20 in response to engagement between the pull tab 11 and a pull tab locking means when the pull tab 11 is inserted into the channel 18, until the pull tab 11 becomes locked by the locking means, as will be discussed more fully hereinafter. Although in the illustrated embodiment the slits 27 are formed in the upper plate 19, they may be formed in either one of or both of the upper and lower plates 19,20.

The pull tab locking means is located adjacent to the end wall 22 and comprises a locking projection 29 projecting from the upper plate 19 into the channel 18 toward the lower plate 20 and located on the resilient web portion 28 of the upper plate 19 substantially centrally widthwise of the body 17 at equidistant location from the slits 27 and the sidewalls 21, such that the lateral projection 16 of the pull tab 11 will be aligned with the locking projection 29 when the pull tab 11 is inserted into the channel 18. The projection 29 has a vertical edge 30 facing the channel end 22, and a cam surface 31 that projects progressively into the channel 18 in a direction from the opening 26 to the end wall 22 of the channel 18, the cam surface 31 terminating at the vertical edge 30. When the pull tab 11 is inserted in position in the channel 18, the vertical edge 30 of the projection 29 engages the lateral projection 16 of the pull tab 11 for locking the pull tab 11 in the channel 18 against removal therefrom. The cam surface 31 of the projection 29 causes the pull tab 11 on engagement therewith to displace the resilient web portion 28 of the upper plate 19 against the resiliency thereof when the pull tab is inserted into the channel 18, until the pull tab 11 becomes locked by engaging its lateral projection 16 with the vertical edge 30 of the projection 29.

Figure 3:
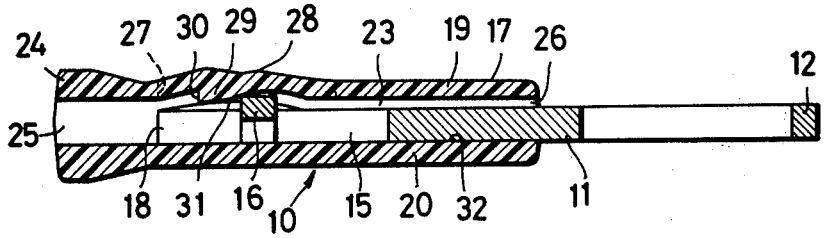
FIG. 3 is an enlarged vertical cross-sectional view of the ornamental attachment as it is fitting over the slider pull tab.
Figure 4:
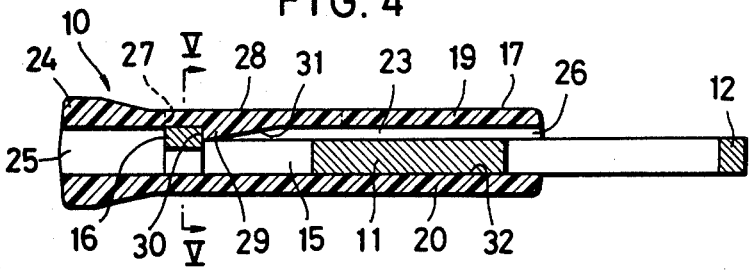
FIG. 4 is an enlarged vertical cross-sectional view of the ornamental attachment as it fits over the slider pull tab.

The ornamental attachment 10 will be attached to the pull tab 11 as follows: The pull tab 11 over which the ornamental attachment 10 is to be fitted is preferrably formed by pressing and punching a sheet of metal or by die-casting from a molten metal and has a maximum thickness (at the lateral projection 16) should preferably be substantially equal to or may be slightly smaller or greater than the height of the opening 26 of the channel 18 in the attachment body 17. The ornamental attachment 10 is moved toward the pull tab 11 to allow the latter to be progressively inserted into the channel 18 with the projection 16 foremost, as shown in FIG. 2 complemental fitting relation to the guide groove 23 in the upper plate 19. As the ornamental attachment 10 continues to move forward while being guided by an upper surface 32 of the lower plate 20, the guide groove 23 in the upper plate 19 and a pair of confronting lateral guide surfaces 33 (FIGS. 2 and 5) of the sidewalls 21, the lateral projections 16 of the pull tab 11 starts riding onto the cam surface 31 of the lateral projection 29 (In FIG. 5, the opposite side edges of the pull tab 11 are shown as being held apart from the guide surfaces 33 of the sidewalls 21, respectively due to the cutting-plane line V—V shown in FIG. 4 passing through the pull tab 11 transversely across the distal end thereof at the chamfered corners shown in FIG. 2.). Continuous advancing movement of the ornamental attachment 10 causes the lateral projection 16 of the pull tab 16 to engage and push the cam surface 31 of the projection 29 upwardly, whereupon the resilient web portion 28 of the upper plate 19 is forced to displace upwardly away from the bottom plate 20 as illustrated in FIG. 3. When the lateral projection 16 of the pull tab 11 moves past or slides over the cam surface 31 of the locking projection 29, the resilient web portion 28 spring back downwardly due to its own resiliency toward the lower plate 20, whereupon the lateral projection 16 of the pull tab 11 snappedly engages the vertical edge 30 of the locking projection 29 as shown in FIG. 4.

The pull tab 11 thus fitted and locked in the channel 18 is held intimately surrunded by the upper and lower plates 19,20, the sidwalls 21 and the end wall 22 of the attachment body 17. Thus, the ornamental attachment 10 is stably retained on the pull tab 11 against wobbling movement. As the slits 27 extend along lines parallel to a line along which forces tending to pull the ornamental attachment 10 off the pull tab 11 are applied, they give the resilient web portion 28 defined therebetween resistance enough to prevent the web portion 28 from being resiliently deformed or displaced when the forces are exerted on the locking projection 29 at each time of slider manipulation. The resilient web portion 28 has a mechanical strength sufficiently large lengthwise to prevent damages thereto due to stresses applied during or fatgue resulting from frequent usage of the slider 14. Furthermore, the ornamental attachment 10 can easily be attached to the pull tab 11 simply by fitting the attachment 10 over the pull tab 11 in a single stroke.

Figure 6:
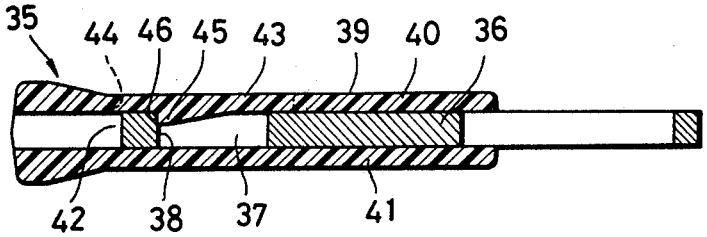
FIG. 6 is an enlarged vertical cross-sectional view of an ornamental attachment according to another embodiment, as attached to a slider pull tab with no lateral projection.

FIG. 6 illustrates a modified ornamental attachment 35 for a slider pull tab 36 which has an opening 37 bounded by an edge 38 at its distal end but devoids of the lateral projection shown in the foregoing embodiment. The ornamental attachment 35 comprises an elongate body 39 including a pair of upper and lower plates 40,41 defining therebetween a channel 42 for receiving the slider pull tab 36 therein, the upper plate 40 having no guide groove recessed therein. There is a resilient web portion 43 defined by a pair of slits 44 (only one shown by dotted line) and onto which is located a locking projection 45 projecting from the upper plate 40 into the channel 42 and having an vertical edge 46 adapted for locking engagement with the edge 38 of the slider pull tab opening 37. The other structural details and the way in which the attachment 35 is assembled onto the pull tab 36 are the same as those disclosed in connection with the embodiment shown in FIGS. 2 to 5.

Although certain preferred embodiments of the invention have been shown and described for the purposes of illustration, it is to be understood that various changes and modifications may be made without departing from the scope of the appended claims.

I claim as my invention:

1. An ornamental attachment for a slide fastener slider with a pull tab, comprising:

(a) a body having a pair of spaced plates defining therebetween a channel for receiving therein the pull tab;

(b) a locking projection extending from one of said plates into said channel for locking the pull tab in said channel; and (c) said one plate having a pair of laterally spaced slits communicating with and extending longitudinally of said channel to define therebetween a resilient web portion, said resilient web portion being connected at both opposite ends to said one plate and displaceable against the resiliency thereof away from the other plate in response to engagement between the pull tab and said locking projection when the pull tab is inserted into said channel, until the pull tab becomes locked by said locking projection;

(d) both of said plates extending outwardly beyond said pull tab when locked in said channel and being connected together at their outward end portions.

2. An ornamental attachment according to claim 1 for a slide fastener slider with a pull tab having an opening bounded by an edge, said locking projection having an edge adapted for locking engagement with the pull tab opening edge.

3. An ornamental attachment according to claim 1 for a slide fastener slider with a pull tab having a lateral projection, said locking projection having an edge adapted for locking engagement with the lateral projection of the pull tab.

4. An ornamental attachment according to claim 2 or 3, said locking projection further having cam surface for causing the pull tab on engagement therewith to displace said resilient web portion against the resiliency thereof.

5. An ornamental attachment according to claim 4, said channel having open and closed ends, said cam surface projecting progressively into said channel in a direction from said open end to said closed end.

6. An ornamental attachment according to claim 5, said edge of said locking projection facing said closed channel end, and said cam surface terminating at said edge.

7. An ornamental attachment according to claim 1, said locking projection being disposed on said resilient web portion.

8. An ornamental attachment according to claim 1, said slits extending in parallel and laterally aligned relation to one another.

9. An ornamental attachment according to claim 3, said first named one plate having a groove recessed therein and opening toward said channel, said groove extending longitudinally of said channel in longitudinal alignment with said locking projection for guidingly receiving therein the pull tab lateral projection.

* * * * *